US006315530B1

(12) United States Patent
Goodnick et al.

(10) Patent No.: US 6,315,530 B1
(45) Date of Patent: Nov. 13, 2001

(54) SUBMERGED PUMP HAVING A SHAFT ISOLATOR

(75) Inventors: Douglas J. Goodnick, Niagara Falls; Kenneth E. Wasch, Amherst; Martin G. Leslie, Lockport; Maynard J. Neal, N. Tonawanda, all of NY (US)

(73) Assignee: Buffalo Pumps, Inc., North Tonawanda, NY (US)

( * ) Notice: Subject to any disclaimer, the term of this patent is extended or adjusted under 35 U.S.C. 154(b) by 0 days.

(21) Appl. No.: 09/614,404

(22) Filed: Jul. 12, 2000

Related U.S. Application Data

(60) Provisional application No. 60/157,732, filed on Oct. 5, 1999.

(51) Int. Cl.[7] ..... F01D 13/08
(52) U.S. Cl. ..... 417/424.1; 415/229
(58) Field of Search ..... 415/229; 417/423.1, 417/424.1

(56) References Cited

U.S. PATENT DOCUMENTS

| | | | | |
|---|---|---|---|---|
| 1,550,194 | * | 8/1925 | Zimansky | 415/229 |
| 1,577,737 | * | 3/1926 | Lalyne et al. | 417/424.1 |
| 1,704,362 | * | 3/1929 | Johnson | 417/424.1 |
| 1,709,478 | | 4/1929 | Layne . | |
| 1,801,103 | | 4/1931 | Mummert . | |
| 2,149,602 | | 3/1939 | Horvath . | |
| 2,569,741 | | 10/1951 | Arutunoff . | |
| 2,766,696 | | 10/1956 | Lung . | |
| 2,783,400 | | 2/1957 | Arutunoff . | |
| 2,854,595 | | 9/1958 | Artunoff . | |
| 3,179,827 | | 4/1965 | Baker . | |
| 3,475,634 | | 10/1969 | Bogdanov et al. . | |
| 3,782,860 | | 1/1974 | DeLancey et al. . | |
| 3,854,064 | | 12/1974 | Dunbar . | |
| 3,936,221 | | 2/1976 | Lobanoff . | |
| 4,394,140 | | 7/1983 | Liljestrand . | |
| 4,772,183 | | 9/1988 | Durden . | |
| 4,854,828 | | 8/1989 | Haentjens . | |
| 4,992,689 | | 2/1991 | Bookout . | |
| 5,076,762 | | 12/1991 | Lykes et al. . | |
| 5,134,328 | | 7/1992 | Johnatakis et al. . | |
| 5,203,080 | | 4/1993 | Bookout . | |
| 5,367,214 | | 11/1994 | Turner, Jr. . | |
| 5,509,791 | * | 4/1996 | Turner | 417/424.1 |
| 5,796,197 | | 8/1998 | Bookout . | |

* cited by examiner

*Primary Examiner*—Michael Koczo
(74) *Attorney, Agent, or Firm*—Hodgson Russ LLP

(57) ABSTRACT

The present invention is directed to a pump system. The pump system has a motor, a pump shaft, a pumping section, a connecting column, and a shaft isolator. The motor drives the pump shaft and has a bottom surface above a desired medium. The pumping section has a top surface that receives the pump shaft and pumps the desired medium to a predetermined instrument. The connecting column surrounds a predetermined portion of the pump shaft and connects the motor support and pumping section together. The shaft isolator is positioned between the connecting column and the pump shaft, and extends from the top surface of the pumping section to a predetermined height above the desired medium and below the bottom surface of the motor. The resulting pumped medium has an acceptable amount of entrained air that will not adversely affect the predetermined instrument.

5 Claims, 2 Drawing Sheets

SUBMERGED PUMP HAVING A SHAFT ISOLATOR

This application claims priority to U.S. provisional application Ser. No. 60/157,732, filed on Oct. 5, 1999.

FIELD OF THE INVENTION

The present invention relates to vertical liquid medium pump system and an apparatus on the vertical liquid medium pump system to control the amount of entrained air that enters the liquid medium and not adversely affect the pump itself and the corresponding apparatus which the liquid medium is pumped to.

BACKGROUND OF THE INVENTION

Vertical liquid medium pump systems (hereinafter "Pumps") have been made for years. Conventional Pumps have been described in numerous patents. Some of these patents are U.S. Pat. No. 5,076,762 (Inventor: Lykes et al.), U.S. Pat. No. 4,854,828 (Inventor: Haentjens), U.S. Pat. No. 4,772,183 (Inventor: Durden), U.S. Pat. No. 4,394,140 (Inventor: Liljestrand), U.S. Pat. No. 3,936,221 (Inventor: Lobanoff), U.S. Pat. No. 3,782,860 (Inventors: DeLancey et al.), U.S. Pat. No. 3,179,827 (Inventor: Baker), U.S. Pat. No. 2,766,602 (Inventor: Lung), U.S. Pat. No. 2,149,602 (Inventor: Horvath), U.S. Pat. No. 1,801,103 (Inventor: Mummert), and U.S. Pat. No. 1,709,478 (Inventor: Layne), which are all hereby incorporated by reference for disclosing various embodiments of the conventional Pumps. An example of the Pump used in a preferred embodiment of the present invention is Model VCRE, which is made by Buffalo Pumps, Inc. of North Tonawanda, N.Y., the assignee of this application.

The Model VCRE has been manufactured by Buffalo Pumps, Inc. for the last thirty (30) years and is illustrated in FIG. 1. FIG. 1 illustrates the conventional elements found on Pumps 8. The conventional elements include a motor support 10, a pump shaft 12, a pumping section 14, a casing cover 16, a guide bearing 18 and a connecting column 20. The pump shaft 12 extends from the motor support 10 into the pumping section 14. Mounted on the pumping section 14 is the casing cover 16 (a portion of the top section of the pumping section 14) which has an aperture 22. The aperture 22 receives the pump shaft 12 and within aperture 22 is the guide bearing 18. The guide bearing 18 ensures the pump shaft 12 remains in the proper position but does so by not being in constant contact with the pump shaft 12.

The connecting column 20 connects the motor support 10 to the pumping section 14, and obviously surrounds the pump shaft 12. The connecting column 20 has a plurality of bottom apertures 24 to allow a priming instrument 26 to apply a desired medium to the pump shaft 12 within the pumping section 14, and at least one upper aperture 28 so the pumped medium 7 does not contact the motor support 10.

A problem with the conventional pump 8 is that when the pump shaft 12 rotates the pumped medium 7, the pump shaft 12 creates a vortex of the pumped medium 7 in the connecting column 20. The vortex draws air into the . pumped medium 7 which results in the air becoming entrained within the medium 7. The entrained air-medium 7 is then dispersed throughout the entire pumped medium 7. Such a result is undesirable because it is known to those skilled in the art that entrained air-medium, at certain levels, adversely affect the operation of other instruments 30 that receive the pumped medium 7.

SUMMARY OF THE INVENTION

The cited problem, and others not mentioned above, is solved by the present invention. The present invention is directed to a pump system. The pump system has a motor, a pump shaft, a pumping section, a connecting column, and a shaft isolator. The motor rotates the pump shaft and has a bottom surface above a desired medium. The pumping section has a top surface that receives the pump shaft and pumps the desired medium to a predetermined instrument. The connecting column surrounds a predetermined portion of the pumpshaft and connects the motor support and pumping section together. The shaft isolator is positioned between the connecting column and the pump shaft, and extends from the top surface of the pumping section to a predetermined height above the desired medium and below the bottom surface of the motor support. The resulting pumped medium has an acceptable amount of entrained air that will not adversely affect the predetermined instrument.

BRIEF DESCRIPTION OF THE DRAWINGS

A preferred embodiment of the present invention is described in detail hereinafter with reference to the accompanying drawings, in which.

DETAILED DESCRIPTION

Figure 1:
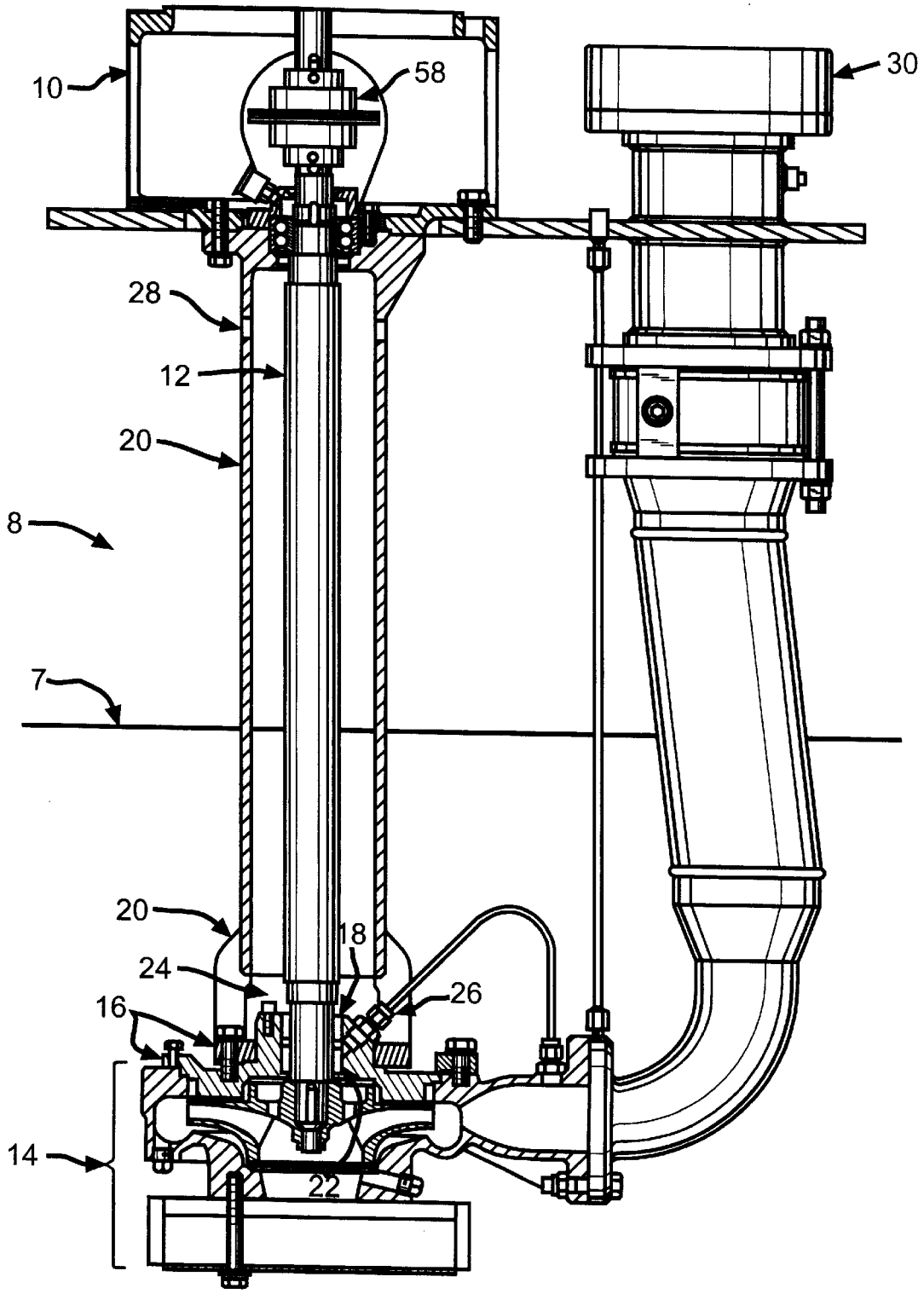
FIG.1 PRIOR ART
FIG. 1 is a representative sample of conventional, and prior art, vertical pumps.
Figure 2:
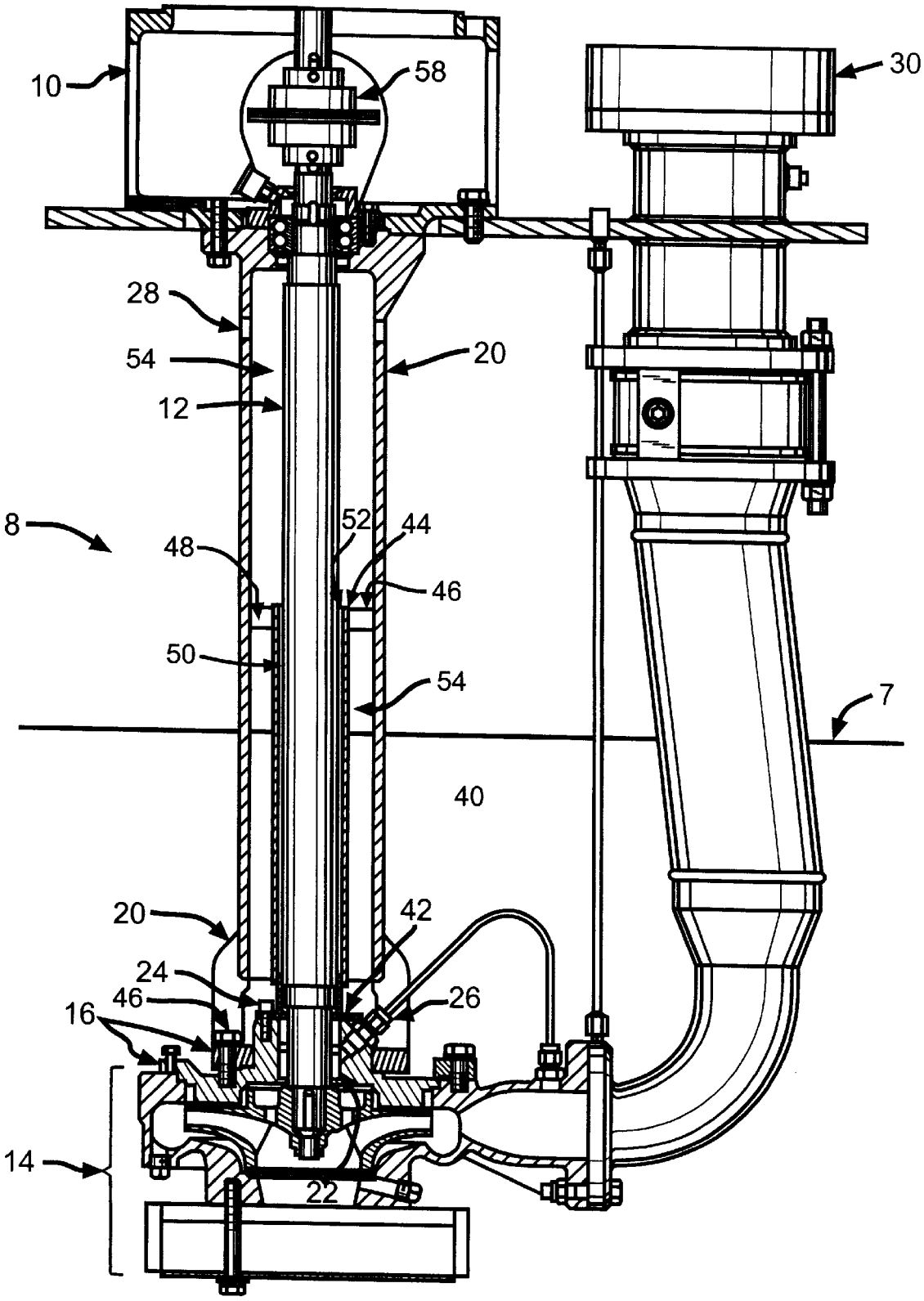
FIG. 2 illustrates the present invention.

The elements set forth in FIG. 1 and described above are the same as illustrated in FIG. 2, except for the shaft isolator 40. The shaft isolator 40 is mounted on the casing cover 16 by conventional means, i.e., screws (as shown in FIG. 2), and extends to a height above the surface of the pumped medium and below the bottom surface of the motor support 10.

The height of the shaft isolator is critical. If the height is below the surface of the pumped medium, then a vortex of the entire pumped medium will occur. And if that occurs, then the present invention has the same problem as FIG. 1 of having too much entrained air within the pumped medium. In contrast, if the shaft isolator 40 contacts the bottom of the motor support 10, then the pumped medium 7 between the pumped shaft 12 and the shaft isolator 40 will penetrate into the motor support 10 and adversely affect a motor 58 that rotates the pump shaft 12. If the motor support 10 is adversely affected, then the motor 10 and the pump system 8 are no better than the prior art. As such, the shaft isolator 40 must have a height between the surface of the pumped medium 7 and the motor support 10.

Likewise, the shaft isolator 40 is positioned between the connecting column 20 and the pump shaft 12. Preferably, the shaft isolator 40 is spaced a distance equivalent or greater than the distance between the guide bearing 18 and the pump shaft 12.

In the present embodiment, the shaft isolator 40 has a base unit 42, a column 44, and ribbed top 46. The base unit 42 has a plurality of apertures, not shown, that correspond with apertures on the casing cover 16. The apertures of the base unit and the casing cover 16 receive screws 46 to secure the base unit 42 to the pumping section 14.

The column 44 extends from the base unit 42 a predetermined height, discussed above, and spaced a predetermined distance from the pump shaft 12 and the connecting column 20, discussed above. And near the top of the column 44 is the ribbed top 46. The ribbed top 46 has at least one rib 48 that extends from column 44 so the pump shaft 12 and the column 44 do not contact each other.

When the pump system 8 operates, the pumped medium 7 normally is pumped into the predetermined instrument 30.

Some of the pumped medium (hereinafter "Cavity Medium 50") seeps into a first cavity 52 between the pump shaft 12 and the shaft isolator 40. The pump shaft 12 vortexes the Cavity Medium 50 resulting in the Cavity Medium 50 having entrained air. The Cavity Medium 50 while being vortexed in the first cavity 52 rises in height until it reaches the top of the column 44 and overflows the ribbed top 46 into a second cavity 54 between the connecting column 20 and the shaft isolator 40. The overflowed Cavity Medium 50 is air-entrained but the amount of air-entrained Cavity Medium 50 is in a controllable amount and is dispersed controllably. By a controllable amount and dispersion, we mean that the air-entrained Cavity Medium 50 is dispersed throughout the pumped medium 7 by having the Cavity Medium 50 slowly enter the pumped medium 7 in the second cavity 54 and slowly circulate through the pumped medium 7 until it is pumped by the pumping section 14. By this method, the Cavity Medium 50 should not be concentrated in an amount that adversely affects, or damages, the other instruments 30.

The shaft isolator 40 can be made of any material that can withstand the adverse affects of the pumped medium 7. For example, if the pumped medium 7 was oil or water, then the material for the shaft isolator 40 is metal, plastic, ceramic or any other conventional material.

Admittedly, the Model VCRE pump is illustrated in FIGS. 1 and 2, but the shaft isolator 40 can be used with any type of vertical pump system.

Although a particular preferred embodiment of the invention has been illustrated and described in detail for illustrative purposes, it will be recognized that variations or modifications of the disclosed apparatus, including the rearrangement of parts, lie within the scope of the invention defined by the claims.

The embodiments of the invention in which an exclusive property or privilege is claimed are defined as follows:

1. A pump system comprising:

a motor that drives a pump shaft and has a bottom surface above a desired medium;

a motor support connected to the motor;

a pumping section having a top surface that receives the pump shaft and pumps the desired medium to a predetermined instrument;

a connecting column that surrounds a predetermined portion of the pump shaft and connects the motor support and pumping section together;

a shaft isolator positioned between the connecting column and the pump shaft, and extends from the top surface of the pumping section to a predetermined height above the desired medium and below the bottom surface of the motor support;

wherein the amount of entrained air in the desired medium is limited to an acceptable amount that will not adversely affect the predetermined instrument.

2. The pump of claim 1 wherein the desired medium is oil.

3. A method of pumping of a desired medium comprising the steps of:

inserting a pump system having a motor that drives a pump shaft and has a bottom surface above a desired medium; a motor support connected to the motor; a pumping section having a top surface that receives the pump shaft and pumps the desired medium to a predetermined instrument; a connecting column that surrounds a predetermined portion of the pump shaft and connects the motor support and pumping section together; and a shaft isolator positioned between the connecting column and the pump shaft, and extends from the top surface of the pumping section to a predetermined height above the desired medium and below the bottom surface of the motor support; into a desired medium;

operating the pump system wherein the resulting pumped desired medium has an acceptable amount of entrained air which will not adversely affect the predetermined instrument.

4. The method of claim 3 wherein the pump system is a vertical pump.

5. The method of claim 3 wherein the desired medium is oil.

* * * * *